United States Patent [19]

Gall et al.

[11] Patent Number: 5,067,142

[45] Date of Patent: Nov. 19, 1991

[54] X-RAY DIAGNOSTICS INSTALLATION WITH A GATING UNIT FOR THE DOMINANT IMAGE REGION

[75] Inventors: Arthur Gall, Langensendelbach; Adelbert Kupfer, Poxdorf, both of Fed. Rep. of Germany

[73] Assignee: Siemens Aktiengesellschaft, Munich, Fed. Rep. of Germany

[21] Appl. No.: 641,787

[22] Filed: Jan. 16, 1991

[30] Foreign Application Priority Data

Jan. 15, 1990 [EP] European Pat. Off. ..... 90100756.7

[51] Int. Cl.[5] ..... H05G 1/64

[52] U.S. Cl. ..... 378/99; 378/98; 358/111

[58] Field of Search ..... 378/97-99, 378/62, 108, 147, 148, 149-157, 110, 112; 358/111, 162, 168, 202-204

[56] References Cited

U.S. PATENT DOCUMENTS 3,539,813 11/1970 Resnick .
4,335,307 6/1982 DeVries et al. ..... 378/97

FOREIGN PATENT DOCUMENTS 0087843 9/1983 European Pat. Off. .
0084738 3/1984 European Pat. Off. .
0S3127648 1/1983 Fed. Rep. of Germany .
0S3802351 8/1989 Fed. Rep. of Germany .
2132460 7/1984 United Kingdom .

*Primary Examiner*—Janice A. Howell
*Assistant Examiner*—David P. Porta
*Attorney, Agent, or Firm*—Hill, Van Santen, Steadman & Simpson

[57] ABSTRACT

An x-ray diagnostics installation for producing x-ray images has an x-ray image intensifier and a detector for measuring the average image brightness in a dominant region of the output screen of the x-ray image intensifier, and a gating unit with which the size and position of the dominant region can be varied. The gating unit is in the form of a tape roll of opaque material having a number of differently sized and shaped openings therein, corresponding to different desired measuring fields. A large number of differing dominant regions can thereby be selected by means of a unit which occupies a small space.

8 Claims, 2 Drawing Sheets

X-RAY DIAGNOSTICS INSTALLATION WITH A GATING UNIT FOR THE DOMINANT IMAGE REGION

BACKGROUND OF THE INVENTION

1. Field of the Invention

The present invention is directed to an x-ray diagnostics installation which includes means for varying the size and position of a dominant region of the x-ray image.

2. Description of the Prior Art

X-ray diagnostics systems are known which generate x-ray images, the x-ray image frequently including a dominant region of interest within the image, which contains the primary item of medical interest within the image. Such installation include an x-ray image intensifier and a detector for measuring the average image brightness in the dominant region of the output screen of the x-ray image intensifier. Such systems are used for video image reproduction, as well as producing individual images and series of images, with the detector maintaining the average image brightness constant in the dominant region.

It is known to selectively vary, within limits, the size and shape of the dominant region, as described in German OS 31 27 648. In this known installation, a portion of the image is reflected by a mirror out of the parallel light beam path of the optics system, the optics system being disposed between the output luminescent screen of x-ray image intensifier and the video camera. The mirror is disposed directly in the parallel beam path, and the portion of the image reflected out of the beam path by the mirror constitutes the dominant region. Selection of the size and shape of the dominant region is undertaken by a dominant disc which precedes a photomultiplier. The physical size of the dominant disc, however, places limits in the number of different shapes, positions and sizes of the dominant region which can selected, because all of these variations must be accommodated within the dominant disc.

It is generally standard in such x-ray image intensifiers to switch the format of the x-ray image intensifier dependent on the size of the subject under observation and on a desired magnification, so that identical areas in the input luminescent screen illuminate a different area on the output luminescent screen. A magnification of the examination subject can thereby be achieved in a simple manner. A disadvantage in such known systems, however, is that the dominant region changes due to the switching of the x-ray image intensifier. This can be prevented by providing an appropriate opening in the dominant disc for each setting of the x-ray image intensifier, and by correspondingly adjusting the dominant disc at the time a switching of the x-ray image intensifier is undertaken. This technique also requires a large number of openings be provided in the dominant disc, not only for each desired shape and position of the dominant region, but also for each imaging scale of the x-ray image intensifier. Again, this results in a dominant disc which is of an unmanageably large size.

SUMMARY OF THE INVENTION

It is an object of the present invention to provide means in an x-ray diagnostics installation for selecting the size, position and shape of the dominant image region, the means for varying having only a small structural size.

The above object is achieved in accordance with the principles of the present invention in an x-ray diagnostics installation wherein the means for varying the size, position and shape of the dominant region is a tape or web roll of opaque material having a plurality of openings therein corresponding to the various sizes, shapes and positions of measuring fields for the dominant region. A large number of different dominant regions, differing in position, shape and size, can thereby be set in a simple manner, and the gating unit occupies only a small space.

The tape roll in an embodiment of the invention may be driven by a drive motor with the tape being wound on a driven roll and a take-up roll, in the manner of a conveyor. Preferably the driven roller is connected to a torsion spring which generates a tensioning force on the tape. Conveying of the tape roll can also be achieved by providing the drive motor with a gear wheel which engages perforations at an edge of the tape. This achieves a reliable and non-slip control of the measuring fields.

Preferably the driven roller is provided with oppositely acting means for tensioning the tape.

Simple interchangeability of the tape roll can be achieved by integrating the tape roll in a cassette. The control time, i.e., the time required to move the tape from one selected field to another, can be shortened in an embodiment wherein the tape is a continuous tape wound around two rolls.

DESCRIPTION OF THE PREFERRED EMBODIMENTS

Figure 1:
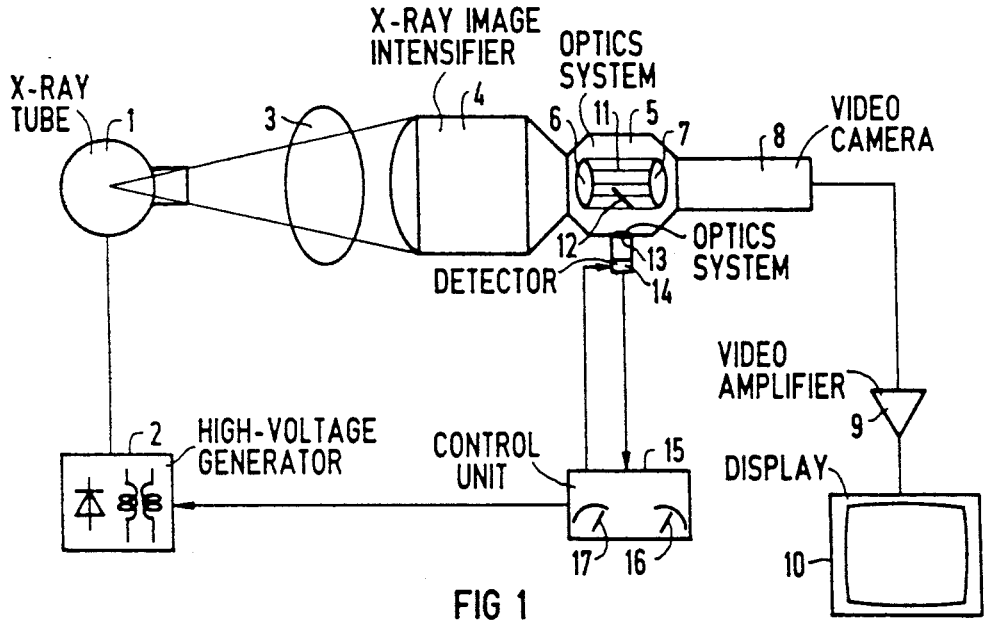
FIG. 1 is a block diagram of an x-ray diagnostics installation constructed in accordance with the principles of the present invention.

An x-ray diagnostics system is shown in FIG. 1 which includes an x-ray tube 1 which is supplied by a high-voltage generator 2. The x-ray tube 1 emits an x-ray beam which passes through a patient 3. Radiation attenuated by the patient 3 is incident on the input luminescent screen of an x-ray image intensifier 4. The x-ray image intensifier 4 converts the radiation image into a visible image at its output luminescent screen 18. An optics system 5, which includes a base objective lens 6 and a camera objective lens 7 is coupled to the x-ray image intensifier 4. The output image of the x-ray image intensifier 4 is directed as an image on a target 19 of a video camera 8 through the objective lenses 6 and 7. The output signal of the video camera 8 is amplified in a video amplifier 9 and is reproduced on a display 10.

A mirror 12 is disposed in the telecentric beam path 11 between the base objective lens 6 and the camera objective lens 7, and thus directs a portion of the parallel rays laterally out of the telecentric beam path 11. A further optics system 13 generates an image on a detector 14 which may be, for example, a photomultiplier.

The detector 14 is connected to a measuring amplifier (not shown) arranged in a control unit 15. The control unit 15 includes a control 16 for setting the rate value of the brightness of the image. The control unit 15 is connected to the high-voltage generator 2 for controlling the exposure by adjustment of x-ray tube operating parameters.

Figure 2:
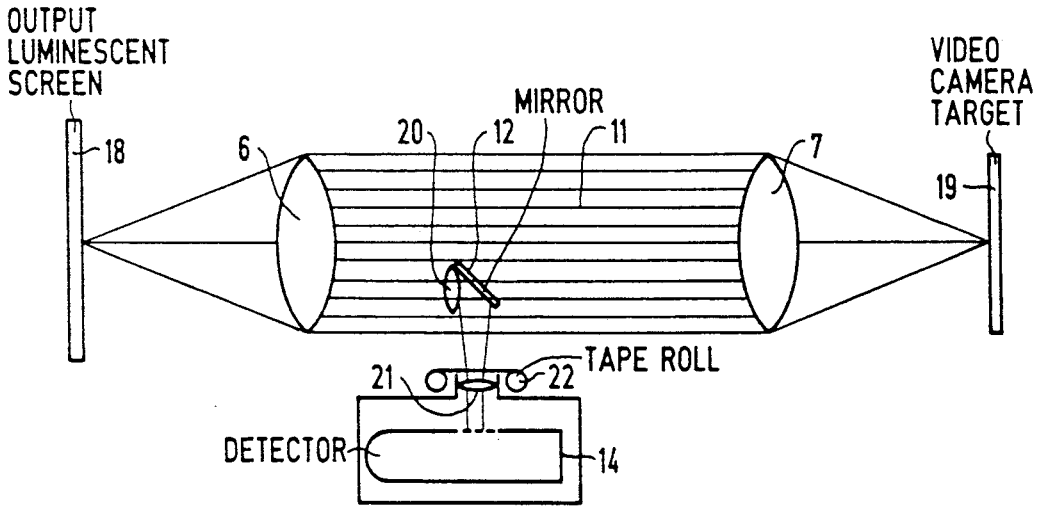
FIG. 2 is an enlarged portion of the x-ray diagnostics installation of FIG. 1 showing details of the gating unit constructed in accordance with the principles of the present invention.

The beam path between the base objective lens 6 and the camera objective lens 7 is shown in greater detail in FIG. 2. The light diverging from a point on the output luminescent screen 18 of the x-ray image intensifier 4 is acquired by the base objective lens 6, and is converted into the telecentric beam path 11, having parallel rays. The camera objective lens 7 acquires the beam path 11 and generates an image of the point by converging the rays on the target 19 of the video camera 8.

The mirror 12, which may alternatively be a prism, is disposed in the telecentric beam path 11. A first lens 20 of the optics system 13 is disposed in front of the mirror surface. A second lens 21, at a distance behind the mirror 12, is disposed in front of the detector 14. The second lens 21 generates the image on the detector 14. The lenses in the optics system 13 are set so that the output image of the x-ray image intensifier 4 can be completely imaged in the image plane on a tape roll 22 disposed in front of the lens 21 of the detector 14. For defining the measuring field of the dominant region, the tape roll 22 covers parts of the output image of the x-ray image intensifier 4, so that only those portions which remain can contribute to controlling the exposure.

Figure 3:
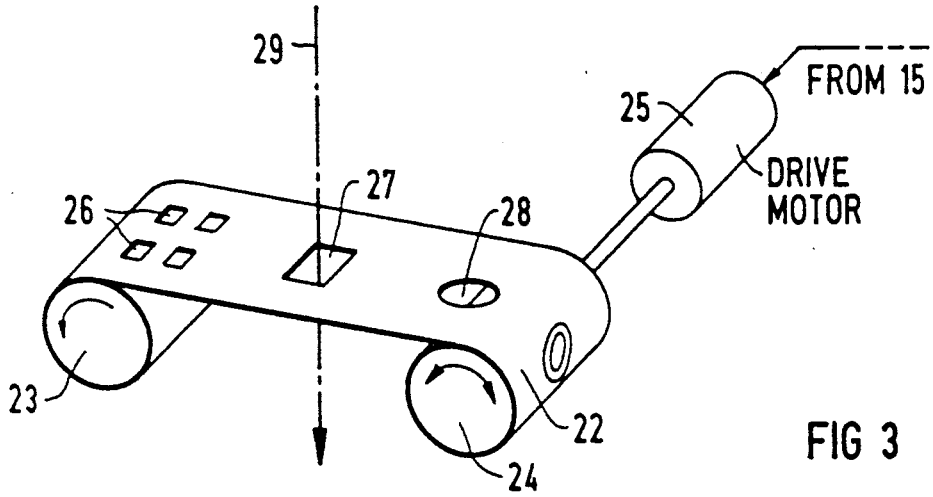
FIGS. 3 through 5 are perspective views of various embodiments of tape rolls constructed in accordance with the principles of the present invention, suitable for use in the arrangement shown in FIG. 2.

A roll tape 22 of the invention is shown in FIG. 3, wound on two conveying rollers 23 and 24. A drive motor 25, for example a stepping motor, is attached to the conveying roller 24. The drive motor 25 is operated by a control 17 in the control unit 15. The conveying roller 23 may be connected to means for generating tension, for example a torsion spring, so that the roll tape 22 is suspended tightly between the rollers 23 and 24.

Figure 4:
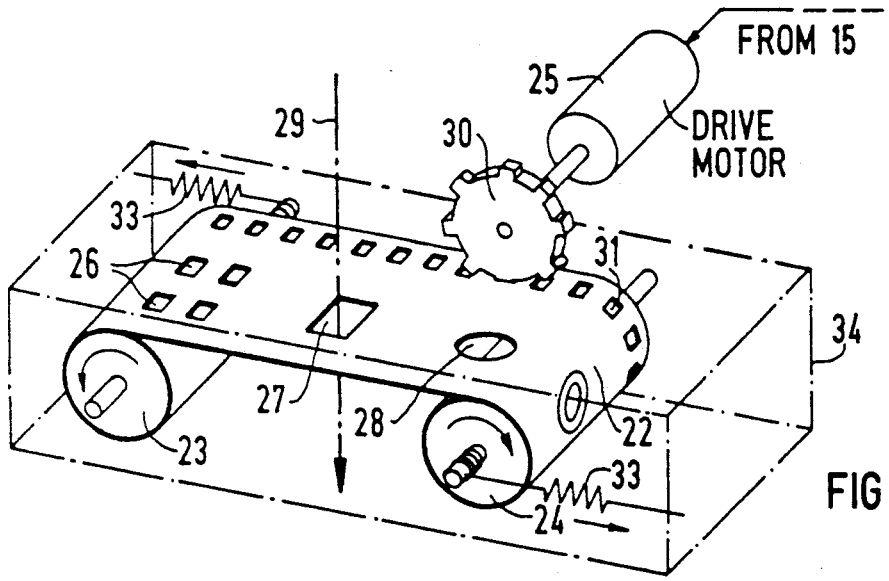
Figure 5:
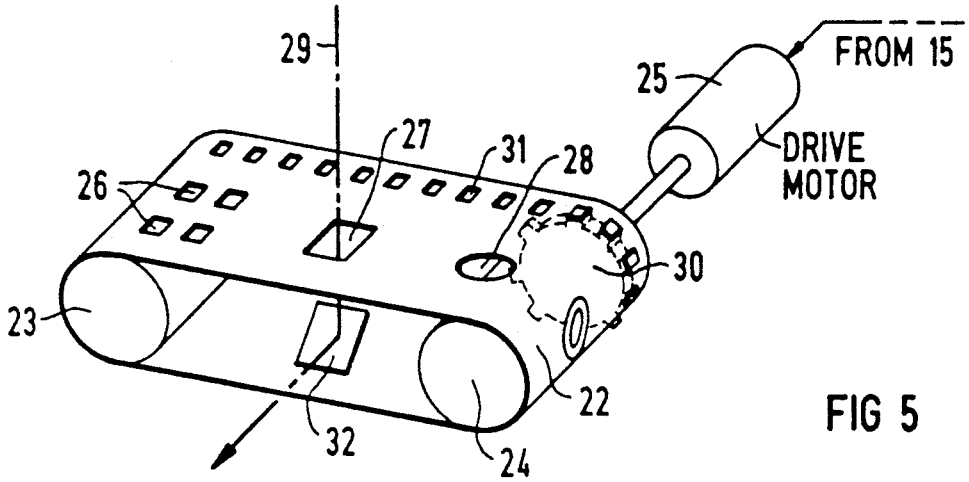

The tape roll 22 has a plurality of openings therein, and is otherwise opaque. Exemplary openings 26, 27 and 28 are shown in FIGS. 3, 4 and 5 which show the different varieties of shape, position and number of openings. The openings 26 through 28, as well as other openings which may be provided in the roll tape 22, define respective dominant regions which are used for measurement. In the position of the tape roll 22 shown in FIG. 3, the beam path 29 from the lens 20 proceeds through the opening 27, and is gated or limited as a result. The second lens 21 images the rays which pass through the opening 27 onto the detector 14, so that only that portion of the beam path which has penetrated through the opening 27 contributes to the measurement.

The tape roll 22 may consist of any suitably opaque material. A metal foil or a plastic foil may be preferably employed.

A different drive arrangement for the tape roll 22 is shown in FIG. 4. In this embodiment, the drive motor 25 is connected to a gear wheel 30 which engages a perforation 31 in the roll tape 22 for conveying the roll tape 22. For tensing the roll tape 22, the conveying rollers 23 and 24 are each provided with oppositely acting means for generating a tensioning force, for example, torsion springs 33. (The springs 33 are only schematically shown in FIG. 4, and it will be understood that the spring arrangement will be such as to produce tensioning forces acting perpendicularly and/or tangentially to the axles of the rolls 23 and 24.)

In the embodiment of FIG. 5, the tape roll 22 is a continuous tape. The continuous tape is entrained around the conveying rollers 23 and 24. The gear wheel 30 of the drive motor 25 engages perforations 31 at the edge of the tape roll 22. A mirror 32 may be disposed between the two sides of the tape roll 22, which deflects the beam path 29 onto the detector 14 (not shown in FIG. 5). It is also possible, however, to arrange the detector 14 directly between the two sides of the tape roll 22. To reduce the size of the arrangement for gating the measuring field, the continuous tape may be guided in a meandering path, if the tape roll 22 has an exceptionally large number of different openings therein.

It is also possible to provide for manual actuation of the tape roll 22, for example, with a ratchet or a control knob, instead of a motor drive.

As schematically shown in FIG. 4, the gating device can be integrated in a cassette 34, similar to roll film cassettes for photographic equipment. The cassette 34 will have suitable openings therein (not shown) to permit engagement of the drive elements. Arrangement of the gating system in a cassette 34 permits the device enclosed within the cassette to rapidly changed within the installation.

The gating device in the form of the tape roll 22 results in an x-ray diagnostics installation wherein an arbitrary number of measuring fields having arbitrary sizes and positions can be accommodated on the tape. The measuring field can therefore be adapted to conform to the particular needs of a customer. The roll tapes 22 which define the measuring field size of the dominant region can be easily replaced by service personnel as needed.

Although modifications and changes may be suggested by those skilled in the art, it is the intention of the inventors to embody within the patent warranted hereon all changes and modifications as reasonably and properly come within the scope of their contribution to the art.

We claim as our invention:

1. In an x-ray diagnostics installation for producing x-ray images having an x-ray image intensifier and means for measuring the average image brightness in a dominant image region of the output luminescent screen of the x-ray image intensifier, the improvement of a gating device disposed in a light beam path between said output luminescent screen and said detector, said gating device comprising:

a tape roll consisting of optically opaque material and having a plurality of openings therein of respectively different sizes, shapes and positions; and means for operating said tape roll to selectively position one of said openings in said beam path to limit the light in said beam path which is incident on said detector.

2. The improvement of claim 1 wherein said means for operating includes a drive motor.

3. The improvement of claim 2 wherein said tape roll includes a conveying roller and wherein said drive motor is connected to said conveying roller.

4. The improvement of claim 3 further comprising means connected to said conveying roller for tensing said tape roll.

5. The improvement of claim 2 wherein said tape roll has a plurality of perforations at an edge thereof, and wherein said drive motor has a gear wheel engaging said perforations for conveying said tape roll.

6. The improvement of claim 2 wherein said tape roll includes two conveying rollers with at least one of said conveying rollers connected to said drive motor, and means for applying tensioning forces acting in opposite directions to said conveying rollers.

7. The improvement of claim 1 further comprising: a cassette containing said tape roll.

8. The improvement of claim 1 wherein said tape roll includes a continuous tape having said openings therein.

* * * * *